US006704425B1

(12) United States Patent
Plummer

(10) Patent No.: US 6,704,425 B1
(45) Date of Patent: Mar. 9, 2004

(54) SYSTEM AND METHOD TO ENHANCE REPRODUCTION OF SUB-BASS FREQUENCIES

(75) Inventor: Jan P. Plummer, Marietta, GA (US)

(73) Assignee: Virtual Bass Technologies, LLC, Marietta, GA (US)

( * ) Notice: Subject to any disclaimer, the term of this patent is extended or adjusted under 35 U.S.C. 154(b) by 0 days.

(21) Appl. No.: 09/443,343

(22) Filed: Nov. 19, 1999

(51) Int. Cl.[7] ..... H04R 25/00
(52) U.S. Cl. ..... 381/339; 381/350; 381/354
(58) Field of Search ..... 381/337, 338, 381/340, 349, 350, 339, 343, 347, 352–354, 160; 181/156, 148, 155, 177, 185, 151

(56) References Cited

U.S. PATENT DOCUMENTS

| | | | | |
|---|---|---|---|---|
| 1,631,646 A | * | 6/1927 | Rice | 312/7.1 |
| 2,171,940 A | * | 9/1939 | MacNabb | 181/148 |
| 3,326,321 A | * | 6/1967 | Valuch | 181/144 |
| 3,327,808 A | * | 6/1967 | Shaper | 181/153 |
| 3,529,691 A | * | 9/1970 | Wesemann | 181/156 |
| 3,684,051 A | | 8/1972 | Hopkins | |
| 3,690,405 A | | 9/1972 | Hance | |
| 3,952,159 A | | 4/1976 | Schott | |
| 4,063,387 A | * | 12/1977 | Mitchell | 181/199 |
| 4,122,314 A | | 10/1978 | Matsuda et al. | |
| 4,122,911 A | | 10/1978 | Croup | |
| 4,284,166 A | | 8/1981 | Gale | |
| 4,356,881 A | * | 11/1982 | Lowell | 181/150 |
| 4,434,507 A | * | 2/1984 | Thomas | 381/122 |
| 4,466,505 A | | 8/1984 | Ritter | |
| 4,714,133 A | | 12/1987 | Skaggs | |
| 5,056,616 A | | 10/1991 | Aström | |
| 5,147,986 A | | 9/1992 | Cockrum et al. | |
| 5,150,417 A | | 9/1992 | Stahl | |
| 5,189,706 A | * | 2/1993 | Saeki | 181/155 |
| 5,306,880 A | * | 4/1994 | Coziar et al. | 181/149 |
| 5,335,283 A | | 8/1994 | Torii | |
| 5,359,158 A | * | 10/1994 | Queen | 181/150 |
| 5,432,860 A | | 7/1995 | Kasajima et al. | |
| 5,514,841 A | | 5/1996 | Rochon | |
| 5,625,701 A | | 4/1997 | Scanlan | |
| 5,657,392 A | | 8/1997 | Bouchard | |
| 5,749,433 A | | 5/1998 | Jackson | |
| 5,892,183 A | | 4/1999 | Roozen et al. | |
| 6,169,811 B1 | | 1/2001 | Croft | |
| 6,176,345 B1 | | 1/2001 | Perkins et al. | |
| 6,389,145 B2 | * | 5/2002 | Baumhauer et al. | 379/432 |

FOREIGN PATENT DOCUMENTS

| | | |
|---|---|---|
| WO | WO 83/00977 | 3/1983 |
| WO | WO 89/03161 | 4/1989 |
| WO | WO 90/11668 | 10/1990 |
| WO | WO 01/37611 A1 | 5/2001 |

* cited by examiner

*Primary Examiner*—Curtis Kuntz
*Assistant Examiner*—P. Dabney
(74) *Attorney, Agent, or Firm*—Myers & Kaplan, LLC

(57) ABSTRACT

A bass reflex loudspeaker system capable of optimized sub-bass (<100 Hz) response. The loudspeaker system incorporates a closed cabinet, an electromechanical driver, a virtual acoustic radial transmission line (VARTL), a reactive alternate density transmission medium (ADTM) load and a radial right angle wave guide (RRAWG). The VARTL is disposed around and in front of the cone of the driver so as to allow the driver to maintain loading to very low frequencies, while simultaneously isolating the driver from reflected signals, acoustic summation or stimulus. The ADTM slows the speed of the wave, thereby causing delay and intentional attenuation of the initial waveform while, by way of radial expansion, allows the proper exit velocity. The RRAWG acts as a guide and is disposed within the VARTL to introduce the signal into the throat of the VARTL, thereby allowing the cone to drive the port air mass and the VARTL air mass with essentially equal pressure on each cycle throughout the frequency range of the VARTL. In addition, the loudspeaker system effectively reduces mechanical vibrations that are normally transferred to the speaker cabinet by effecting a lack of unbalanced pressures.

2 Claims, 6 Drawing Sheets

PROPOSED AMENDED FIGURE

SYSTEM AND METHOD TO ENHANCE REPRODUCTION OF SUB-BASS FREQUENCIES

BACKGROUND OF THE INVENTION

1. Field of The Invention

The invention relates to loudspeaker systems. In particular, the invention relates to loudspeaker systems that enhance the reproduction of sub-bass frequencies.

2. Description of the Prior Art

The major obstacle in accurately reproducing bass frequencies is that of providing consistent acoustic loading of the driver cone at lower frequencies, that is to say frequencies having long wavelengths. In air, the acoustic length of a 20 Hz signal is 56 ft. Therefore, the cone of the driver must have a constant acoustic impedance presented to it throughout the entire wavelength of the signal if distortion and signal loss are to be avoided. This occurs when the cone moves but does not linearly pressurize the adjacent air mass as a signature of the electrical signal input. This requirement contributes directly to the cost of true low frequency sound reproducers, because bass frequencies below 100 Hz become more difficult to produce as the driver dimensions and enclosure volume become small relative to the wavelength. Moreover, room acoustics makes bass systems even more difficult to integrate sonically without expensive hardware and impractical and costly interior modifications.

In the early 1950's the acoustic suspension enclosure for loudspeakers was developed which allowed bass response to be extended. When combined with a smaller enclosure and a driver with a heavy long throw mechanism, a low frequency driver substituted efficiency for low bass extension. The bass reflex enclosure was introduced earlier and popularized in the 1960's by Theile and Small to produce more efficient high Q bass response (boomy) and was easy to manufacture.

From those early days up to the present, virtually all successfully marketed loudspeakers use some variation of such enclosures.

In an effort to satisfy the general population, the audio industry has concentrated on bass magnitude (High Q) rather than quality (critical damping), and as a result, such convention will only support cost effective strategies for volume production.

Accordingly, the bass reflex enclosure system dominates in popularity as it can achieve a balanced pressure dynamic operation at high levels. Thus, it is the most efficient speaker design for its size and least costly to manufacture. Reflex systems are designed to produce the lowest frequencies at the box resonance as output falls at a rate of 24 db/oct below that frequency. This is caused by close coupled acoustic phase cancellations that occur in conjunction with the unloading of the driver and port simultaneously.

In addition, signal purity is compromised in several ways with reflex systems as two distinctive radiating sources are producing the same signals at opposing phases. The system is (periodic)resonant by design and therefore unstable in its damping characteristics. Proper T/S alignment is a must and some loss in transient response is still unavoidable. The rapid roll off (24 db/oct) below resonance and Q variations makes cost effective designs unnaturally boomy in sound quality as the compromises impact overall realism.

Over the years, there have been many attempts to design and build an efficient and useful bass reflex speaker system.

For instance, U.S. Pat. No. 3,684,051 shows a bass reflex loudspeaker cabinet incorporating speakers and a corrugated cardboard acoustic duct. However, since the duct is formed of cardboard, the overall sub-bass frequency response of the speaker is impaired.

U.S. Pat. No. 3,690,405 shows a loudspeaker having a pair of acoustic cavities coupled by a port aperture. The port aperture is included in one of the cavities, and the second cavity may include dampening. The speaker is mounted in the first cavity. Unfortunately, this structure is complicated in design and requires expensive manufacturing procedures.

U.S. Pat. No. 4,714,133 shows a loudspeaker having an enclosure, a cone driver, ports, and an acoustic resonator. The resonator defines front and rear cavities, and serves as the focal point for all radiated or vibration induced audio energy. The ports serve as pressure relief valves to support driver activation of the resonate screen, as a means for matching the driver and the enclosure low frequency resonance, and as a sound dispersion device around the enclosure to create the illusion that sound is not driver oriented but is emanating externally of the enclosure. Nevertheless, sub-bass frequencies are not accurately reproduced by this loudspeaker.

U.S. Pat. No. 5,514,841 shows a reflex compression valve-divided chamber speaker cabinet having a ported speaker baffle chamber, a chamber divider, polyester batting, and a tuned free-flow air slot. The speaker operates on the principle of controlling both compressed and decompressed air flow within the ported speaker baffle chamber by means of the chamber divider, which controls air flow past the divider to form a valve combined with the slot. Unfortunately, this speaker cabinet is complicated in structure and design, and does not offer significant bass response.

In general, none of the previously discussed loudspeakers are suitable for efficient reproduction of sub-bass frequencies, that is to say, frequencies below 100 Hz, without compromising on the quality of low bass signal reproduced. None of these designs emphasizes to shorten the wavelengths of sub-bass frequencies for proper loading of the driver.

Therefore, a need exists for a speaker capable of reproducing sub-bass signals without compromising overall acoustic quality or imposing an undesirable restriction on either the listening environment, or the physical size and decorative appearance of the speakers.

SUMMARY OF THE INVENTION

Accordingly, it is an object of the present invention to provide a full range loudspeaker which offers the beneficial attributes of bass reflex operation while eliminating the adverse effects.

It is another object of the present invention to provide a sub-bass loudspeaker that is efficient, has low cone mass and offers low excursion at its lowest frequencies.

It is a further object of the present invention to provide a sub-bass loudspeaker capable of shielding the driver from signals reflected by the walls of the listening room, or signals which normally alter the radiation resistance and frequency response of the driver cone.

It is yet another object of the present invention to provide in one enclosure, a full range loudspeaker system such as a bass reflex speaker system, a subwoofer system or an auxiliary audio/video product (TV, radio, etc.).

It is a further object of the present invention to provide a loudspeaker having diminished physical vibration from the speaker cabinet.

It is yet a further object of the present invention to provide a sub-bass loudspeaker that is physically small, attractive and cost effective.

Further objects and advantages of the invention will become more readily apparent in view of the following detailed description of the preferred embodiments of the invention.

BRIEF DESCRIPTION OF THE DRAWINGS

The foregoing and other objects, aspects and advantages of the present invention will be better understood from the following detailed description of preferred embodiments of the invention with reference to the drawings, in which.

DETAILED DESCRIPTION OF THE PREFERRED EMBODIMENT

Figure 1:
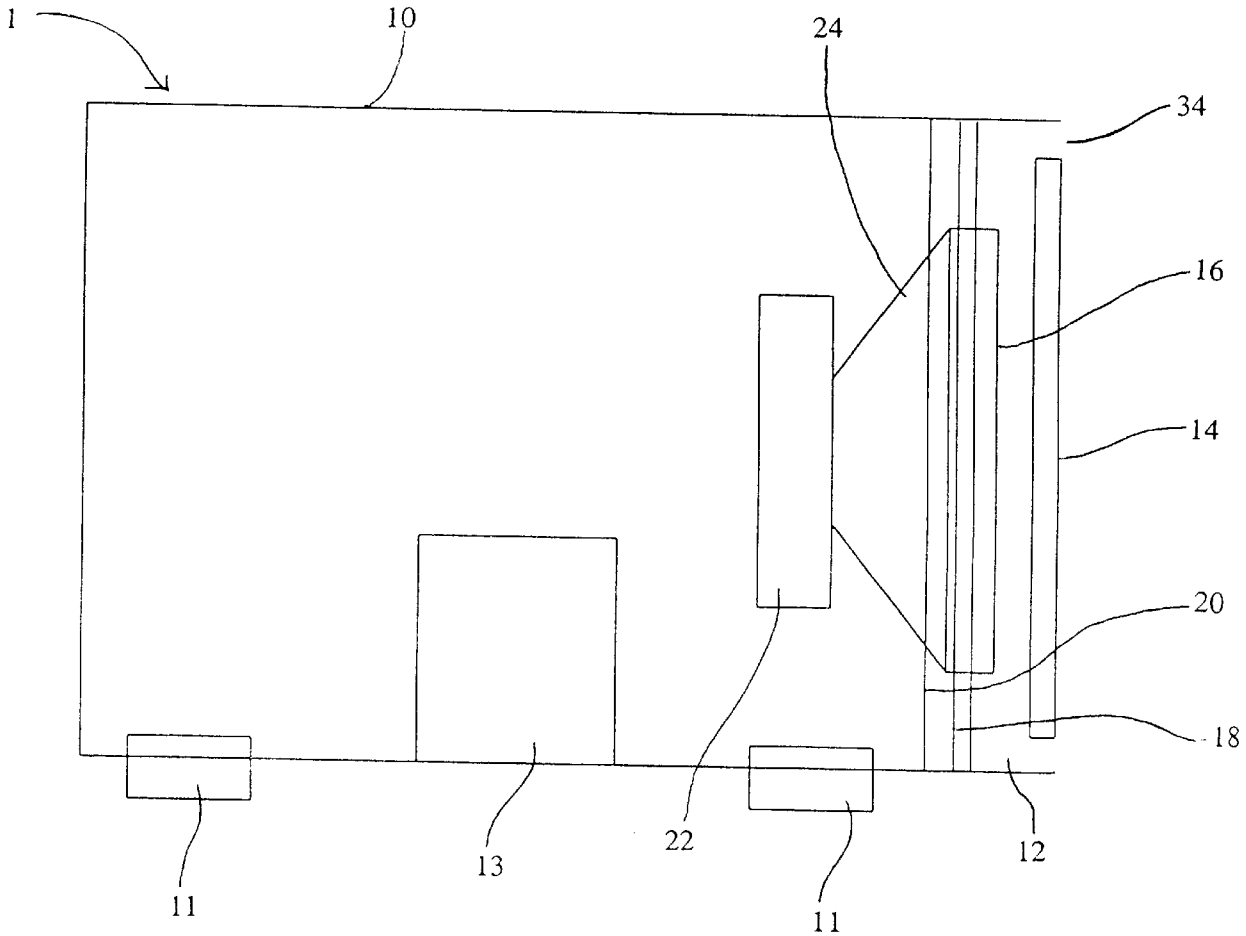
FIG. 1 is a sectional side view of a VARTL modified bass reflex speaker system.

The speaker system 1 of the present invention is clearly shown in FIG. 1.

Throughout this discussion, the terms bass-reflex and reflex are interchangeably used and are meant to denote the type of loudspeaker suitable for reinforcing low frequency acoustic energy. The standard parts required for normal bass reflex loudspeaker operation are: a speaker port, speaker and box. A passive network or active amplification-crossover system is necessary for sub-bass or bass only operation.

The speaker system 1 of the present invention includes a reflex chamber speaker cabinet 10, a dynamic driver 22, waveguides 14, 20, a tuned port 13, a relatively dense reactive element, hereinafter referred to as an alternate density transmission medium ADTM 18, a radial right angle wave guide (RRAWG) 16, and a virtual acoustic radial transmission line (VARTL) 12.

The cabinet 10 supports all components of the system 1. The cabinet 10 is provided with contact supports 11 which serve as feet upon which the cabinet 10 rests. The system 1 may rest upon the floor or may be supported against a vertically disposed wall.

The dynamic driver 22 includes a driver cone 24 front portion. The reactive element 18 serves as the load for the driver cone 24 and slows the speed of the wave causing delay and intentional attenuation through radial expansion.

The driver cone 24 introduces a signal into the throat of the RRAWG 16. The waveguides 14, 20, in conjunction with the reactive element ADTM 18, form the VAKTL 12.

The density of the reactive element 18 and spacing of the waveguides 14, 20 determine the velocity of the wave through the VARTL 12. This velocity controls the air mass within the cabinet 10 with essentially equal pressure on each cycle throughout the frequency range of the system 1. The throat area of the RRAWG 16 and the port 13 area should be similar to allow air to enter and exit the system 1 at similar rates.

Operation of the ADTM 18 will now be explained. The pressure wave enters the radial throat 30 of the VARTL 12, intersecting the ADTM 18 at a narrow angle. A first layer of the airwave encounters the ADTM 18, causing the wave to slow. Viscosity between molecules causes adjacent layers to slow but at decreasing rates. The air molecules begin to tumble, faster in the center, thereby causing a rolling action of the wave as it alternates direction through the VARTL 12. This rolling action creates synthetically a higher air density for the dynamically changing air pressure wave. This constitutes a physical delay and shortened wavelength as the wave passes through the VARTL 12. The wave is therefore in constant air fluid pressure contact with the cone 24 throughout the cycle, even though it will be of extremely long wavelength in normal air density, as emitted at the port 13. The result produces linear motion of the cone 24 due to the fact that there is no pressure build up. In addition, higher bass frequencies are attenuated with VARTL 12 length.

Figure 2:
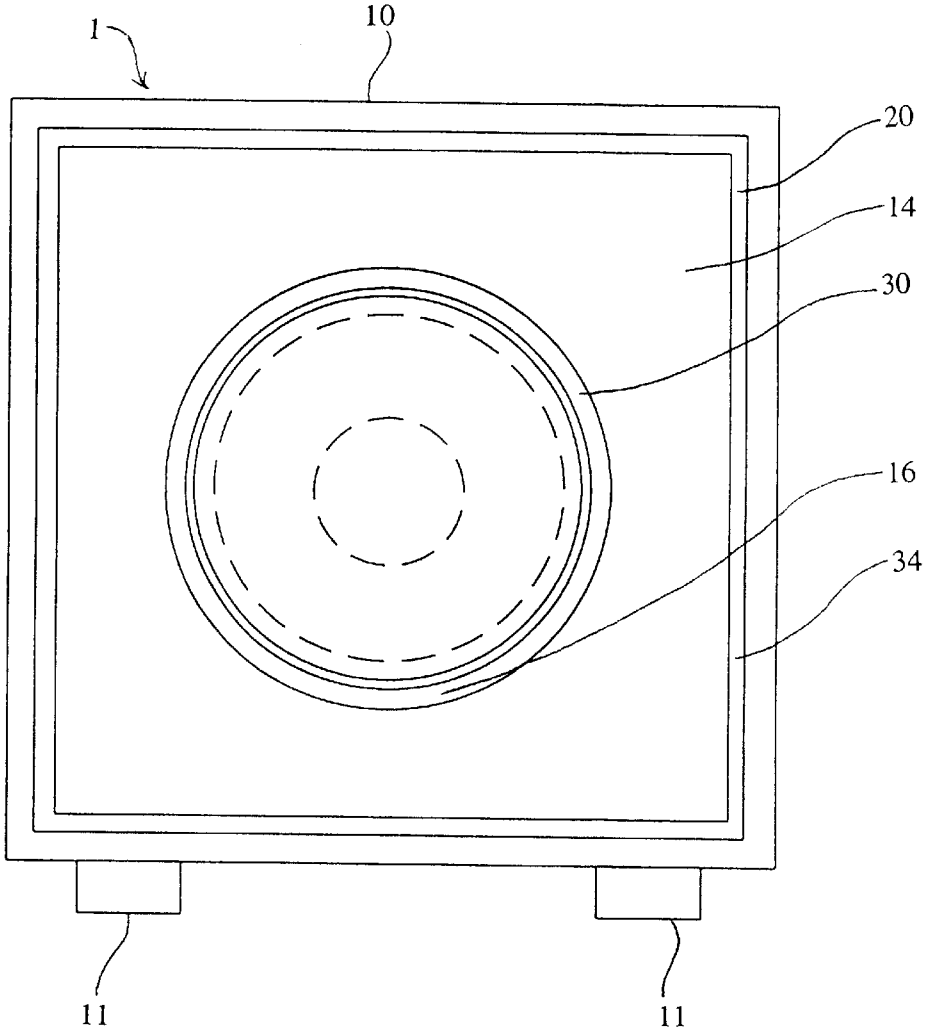
FIG. 2 is a front view of a VARTL modified bass reflex speaker.

Referring to FIG. 2, the VARTL 12 comprises a mouth area 34 that includes the waveguide 14. Directly behind the waveguide 14 is disposed another waveguide 16, hereinafter referred to as a radial right angle waveguide (RRAWG) 16. The RRAWG 16 is located at the center of the waveguide 14.

The ADTM 18 is disposed directly behind the waveguide 14. The ADTM 18, in conjunction with the waveguides 14 and 20, slows the speed of the wave, thereby causing the wavelength to shorten hand dissipate, and through radial expansion, allows the correct exit velocity of the wave. The exit velocity of the wave through the ADTM 18 impinges upon waveguide 20, wherein waveguide 20 is a baffle board layered with the ADTM 18 and serves as a third wave guide. An external panel member 14 can alternatively be layered with the ADTM 18.

A linear pressure wave is created at the port 13 by causing a constant pressure to exist on the front of the driver cone 24, which acting like a throttle, drives the port 13 below and above the resonant frequency of the cabinet 10 with 12 dB/oct high pass and low pass filtering.

The RRAWG 16 introduces the signal into the throat 30 of the VARTL 12, and the mouth area of the RRAWG 16 is essentially the same as the port 13 area, thus allowing the cone 24 to drive the port air mass and the VARTL air mass with approximately the same pressure on each cycle throughout the frequency range of the VARTL 12. Driving the port 13 in this manner increases the overall efficiency of sub-bass operation, while reducing the effective output of the VARTL 12.

The RRAWG 16 output is radially introduced into the mouth of the VARTL 12. An external panel member of similar rigidity and dimension as that of the baffle board 20 or third wave guide is positioned parallel to the baffle 20 with essentially the same physical area dimensions of the baffle less the circumference of the RRAWG 16.

Motion of the cone 24 is linear because there is no pressure build up to alter its inertia as established by the electrical input signal and the VARTL 12. In addition, the VARTL 12 attenuates driver radiated higher bass frequencies, while lower frequencies which enter the VARTL throat 30 are inherently reduced and require less attenuation. This is considered an outstanding feature of the present invention, in that the invention functions primarily to enhance sub-bass frequencies.

The desirable density of the ADTM is 32 kilograms per cubic meter while the normal density of air is 1.19 kilograms per cubic meter. The average density of the VARTL 12 is determined by the panel spacing which directly affects the system Q, wherein Q is the figure of merit for the system. Proper average density will case consistent loading and adequate attenuation of the output of the driver cone 24 with long wavelength signals. The Q can be altered by varying the VARTL 12 panel spacing, the VARTL 12 mouth area, the foam density and dimension, and the RRAWG 16 mouth and throat area. The length of the VARTL 12 is established by the dimensions of the baffle board 20.

The acoustic reactance presented to the cone 24 must be constant for at least ¼ of the wavelength of the pressure wave in order to eliminate non-linearity. Therefore, the VARTL 12 is effective so long as the single pressure wave generated by the driver subject to a radially expanding area which is of greater average density than air. Moreover, the VARTL 12 provides adequate air volume for peak velocities of the cone while absorbing or delaying the lowest desired wavelengths.

The VARTL 12 is not restricted to use in reflex enclosures, but instead can also be used with virtually any bass enclosure capable of establishing and introducing sound pressure into the environment without requiring the direct use of driver front cone output, such as horn coupling, direct radiation, etc.

Operation of the VARTL 12 will now be discussed with reference to FIG. 2. FIG. 2 shows a front view of the VARTL 12 of the present invention.

As a signal enters the VARTL 12, it passes through alternating high density foam and lower density air. The area of the baffle board 20 expands radially as the pressure wave progresses toward the slotted mouth at the periphery of the waveguide 20. Upon arrival at the periphery, the wave is delayed and attenuated.

The internal pressure within the cabinet 10 is equal to the VARTL 12 throat pressure only in the air volume near the vicinity of the rear of the driver cone 24. This pressure region is isolated by the interior volume of the cabinet 10, which accentuates the pressure and the resonate frequency activity of the port 13. At the same time, a passive reference signal of the VARTL 12 is reflected linearly. This passive reference signal, appearing at the mouth of the RRAWG 16, has a similar negative pressure at the immediate rear of the cone 24.

The RRAWG 16 output is radially introduced into the mouth of the VARTL 12. An external panel member of similar rigidity and dimension as that of the baffle board 20 is positioned parallel to the baffle 20 to establish the second waveguide 14, with essentially the same physical area dimensions of the baffle, less the circumference of the RRAWG 16.

The ratio of normal density air to that of the synthetic density of the foam along the length of the baffle board 20 creates an acoustic radial transmission line for all frequencies produced by the driver 22, provided that the same acoustic load, i.e., consumes acoustical energy throughout the pressure cycle, appears on the driver cone 24.

A desirable density of the ADTM 18 is 32 kilograms per cubic meter, while the normal density of air is 1.19 kilograms per cubic meter. The average density of the VARTL 12 is determined by the panel spacing which directly affects the system Q, wherein Q is the figure of merit for the system. Proper average density will cause consistent loading and adequate attenuation of the output of the driver cone 24 with long wavelength signals. The Q can be altered by varying the VARTL 12 panel spacing, the VARTL 12 mouth area, the foam density and dimension, and the mouth and throat area of the RRAWG 16. The length of the VARTL 12 is established by the dimensions of the baffle board 20.

Figure 3:
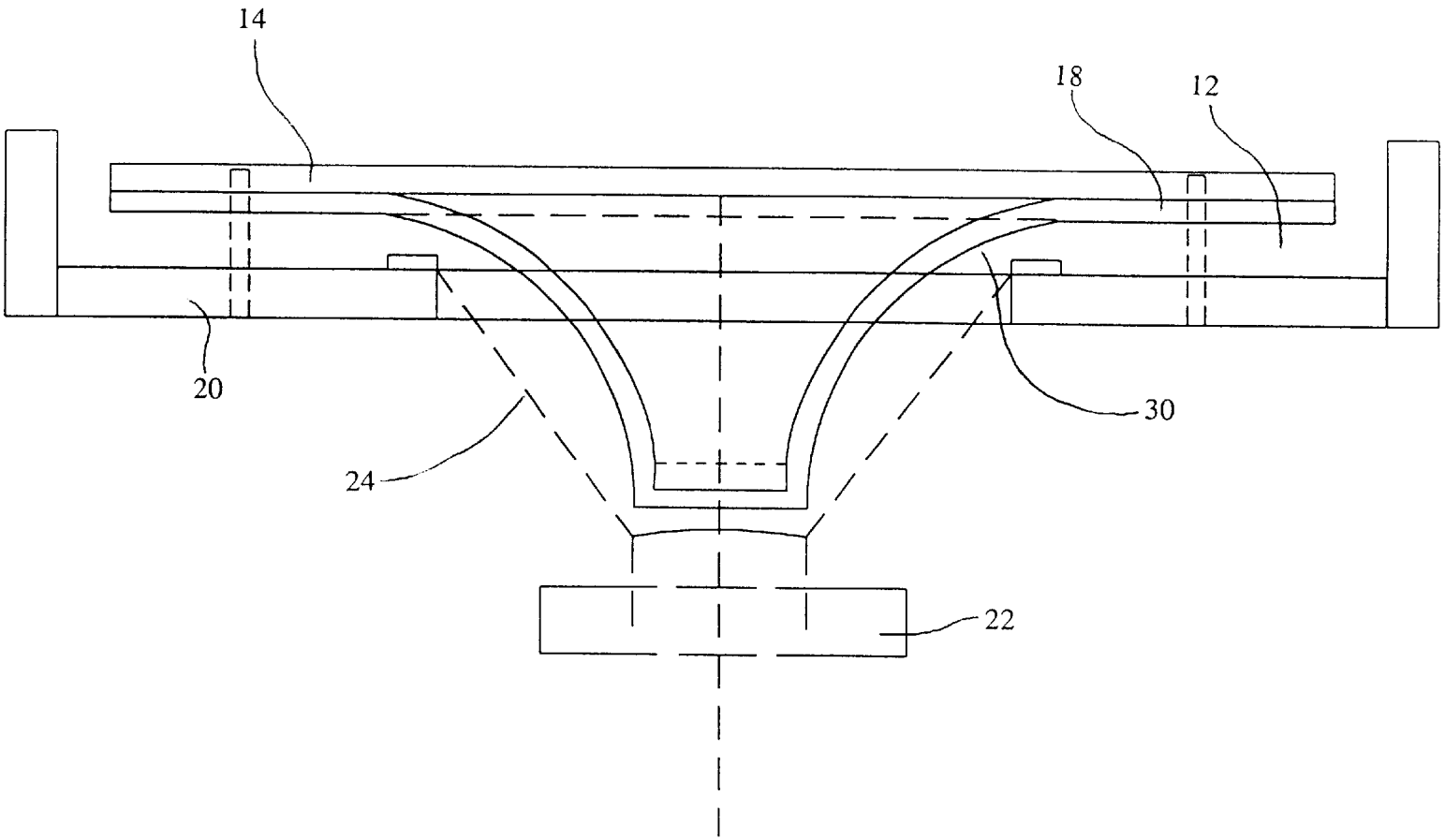
FIG. 3 is a side view of a conical embodiment of a VARTL.

FIG. 3 shows a side view of a conical embodiment of the VARTL 12, in which a single piece waveguide is used in conjunction with the baffle 20 and an additional panel member for an integral second waveguide. All other components in the system 1 are the same as used and discussed with reference to FIGS. 1 and 2.

The acoustic reactance presented to the cone 24 must be constant for at least ¼ of the wavelength of the pressure wave in order to eliminate non-linearity. Therefore, the VARTL 12 is effective so long as ¼ of the length of the single pressure wave generated by the driver is subject to a radially expanding area which is of greater average density than air. Moreover, the VARTL 12 provides adequate air volume for peak velocities of the cone while absorbing and delaying the lowest desired wavelengths.

The ADTM 18 allows a predictable and controllable VARTL 12 reactance to be introduced with the waveguide without over dampening. The Q factor of the system is nominally critical, thereby giving constant amplitude response over the range of its output. (See FIG. 6).

Typically frequencies as low as 20 Hz can be properly terminate in a finite baffle dimension of 100 square inches. Additional VARTL area gained by expanded dimension, i.e., flat extended surface, or folding along box panels, will further increase the attenuation and delay without excess dampening of the cone.

The port 13 is generally located on the cabinet 10 such that it is adjacent and at right angles to a major room surface to assist loading of the port 13 for long wavelengths signals. This assists in matching the port air mass to that of the room as an acoustic transfer phenomena.

With the VARTL 12 properly designed, the driver 22 will not respond to foreign ambient reflections, because although the port 13 is a means of entry into the cabinet 10, the port 13 is primarily sensitive to a narrow range of frequencies pertaining to box resonance and will not transmit external pressure changes efficiently into the cabinet interior. Moreover, the air mass within the cabinet 10 is damped through the driver cone 24 by the VARTL 12 loading, and further damping of the cabinet 10 interior is not generally needed.

The ratio of port 13 area to RRAWG mouth area in front should be near 1:1 with a slightly larger RRAWG 16 mouth area. The RRAWG 16 mouth area and the VARTL throat 30 can be considered the same radial area.

As the area of the RRAWG mouth area decreases, the port 13 impedance magnitude decreases at a greater rate than that of the driver 22, thereby altering the impedance of the system at its lowest frequencies. However, inadequate RRAWG mouth area affects both impedance magnitudes and results in excessive audible turbulence. Inadequate VARTL 12 open space area tends to dampen the resonate impedance peak of both the driver 22 the port 13, in terms of broadband response by limiting required air volume to maintain throughput velocity. This results in a less defined low quality as the Q is excessively low. Excess air space tends to produce an ineffective VARTL 12 as proper dynamic pressurization cannot occur, thus producing an undesirable boomy sound.

Figure 4:
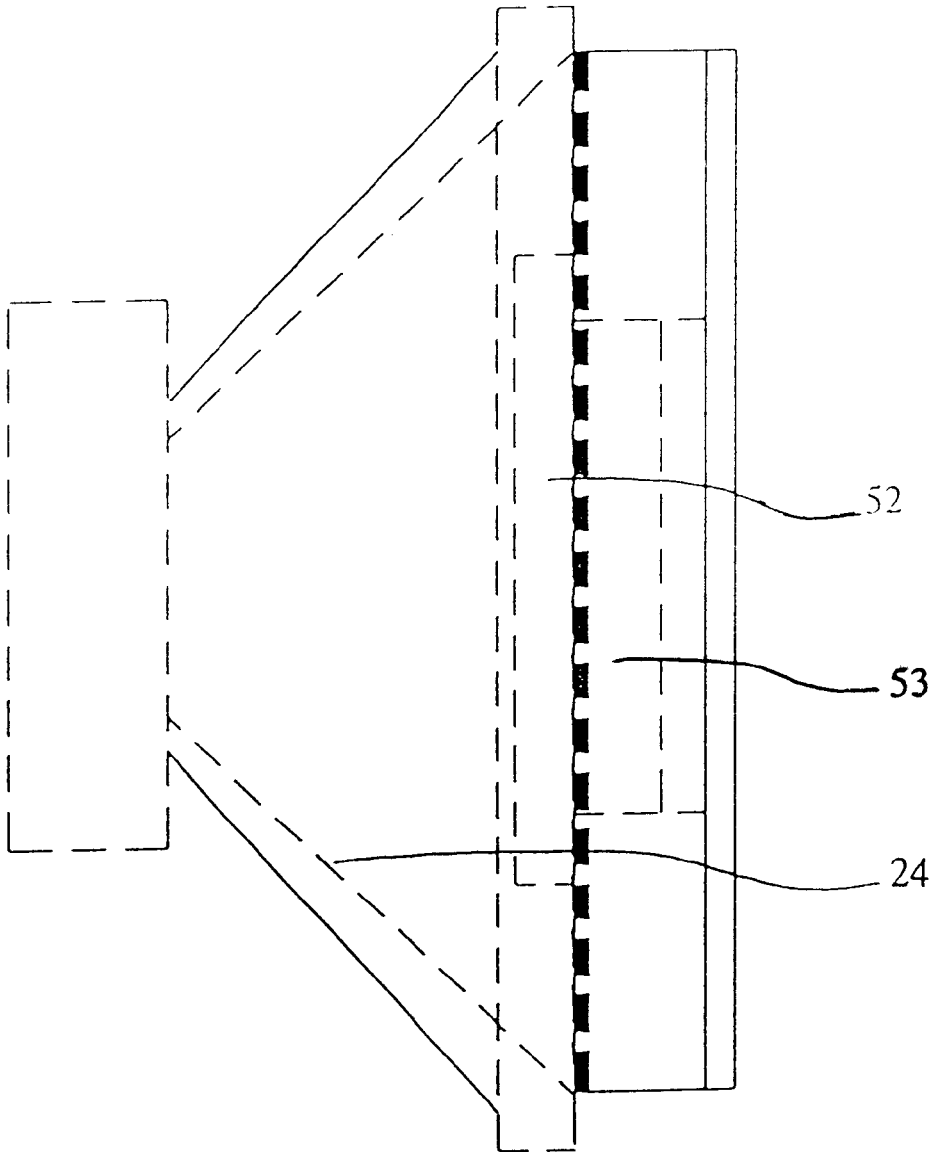
FIG. 4 is a VARTL modified bass reflex speaker system using as a RRAWG.

The RRAWG 16 used in the system 1 will now be discussed in detail with reference to FIG. 4. All other components in the system 1 are the same as used and discussed with respect to FIGS. 1 and 2.

Before beginning the discussion, note that for sub-bass frequency reproduction (<100 Hz), it is desirable to use a separately contained speaker system to avoid intermodulation effects which tend to appear with higher frequencies, to allow for use of separate active crossover-amplification and to permit more flexible placement of the system 1.

The primary function of the RRAWG 16 is to alter the wave direction such that it aligns itself with the parallel orientation of the VARTL 12. This must be done with minimal additional pressure on the driver cone 24 as established by the ratio of port 13 area to RRAWG mouth area.

Mylar disc absorbers 52, 53 are disposed at the acoustical apex of the driver 22. The discs 52, 53 are of different diameters and provide dynamic damping by decreasing the vibrational decay time of the driver 22.

Using air currents, the tensioned low mass and inherently quick recovering mylar-air mass damper will track the air currents and react to dissipate the excess energy stored in the box The air mass and drivers cone-suspension assembly. The inclusion of the MDA 52, 53 insures superior detail and speed as the moving mass in the system is constantly dynamically-dampened.

MDA 52, 53 is surrounded by a non-porous membrane 54 which supports minimal absorption together establishing the initial degree of pressurization at the surface of the cone with the pressure forces guided to the edge by the path of least resistance. A slotted area at the periphery of the inner non-porous membrane 54 allows sound pressure to escape into a second chambered area with a second outer non-porous membrane 55 topically located to allow sound pressure to escape at right angles to its surface and into the mouth of the VARTL 12.

The RRAWG 16 is non-reflective and produces little stored energy at the surface of the driver. As sound pressure enters the throat 30 of the VARTL 12 or the extended acoustical radial transmission line 15, which will be discussed with respect to FIG. 5, it encounters only slight compression resistance. As the wave enters into the ADTM 18, it uses energy to navigate the porous cell structure where it encounters the baffle board 20 and second waveguide structure 14. The incident angle leading into the foam is small, which causes an inclusion of larger longitudinal areas of cell structures in short linear distance.

The radially aligned guides cause the wave to repeatedly encounter the dense porous cell structure of the ADTM 18 causing a spinning action before it exits to the mouth of the VARTL 12. This process repeats until the signal has traversed the entire length of the VARTL 12.

The inner and outer waveguide areas absorb long wavelength signals, while shorter wavelength signals are absorbed nearer the throat of the VARTL 12 with even greater attenuation at the mouth 34. Slotted areas are provided at the periphery of the baffle which serves to admit the pressure wave at a reduced magnitude and altered phase value relative to that of the port 13. The slotted areas can be circular or rectangular, but are generally similar to but less than that of the driver cone area.

It is a requirement that adequate transmission line length exist in the shortest dimension i.e., VARTL throat 30 to VARTL mouth 34, to react with one quarter cycle of the lowest frequency of interest.

The cabinet 10 should be tuned to an adequate low frequency and active or passive circuitry should be used to properly attenuate the input signal to the driver 22 as it approaches driver resonance in order to maximize attainable sub-bass frequency intensity.

Figure 5:
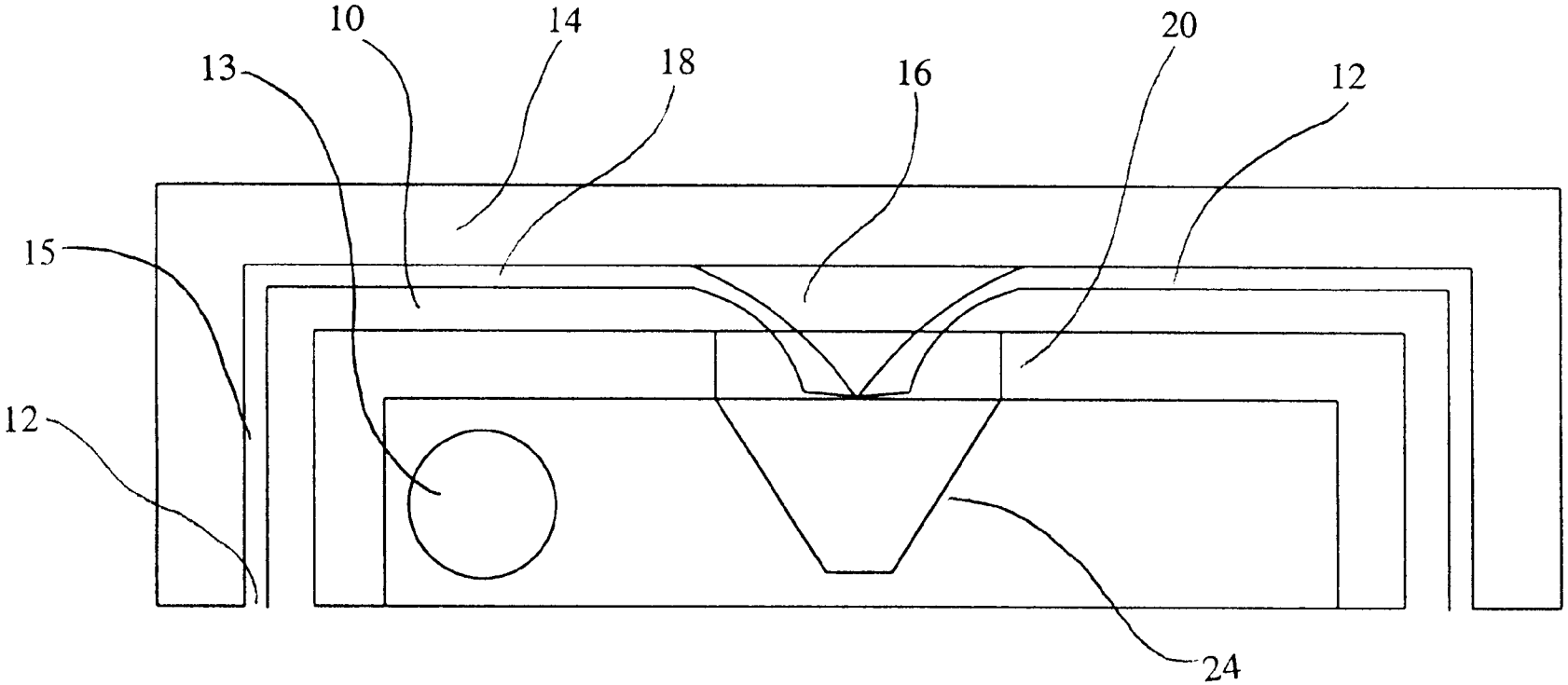
FIG. 5 is a VARTL system with EARTL employed for smaller sub-bass systems.

FIG. 5 shows a VARTL 12 incorporating an extended acoustical radial transmission line (EARTL) 15. All other components in the system 1 are the same as used and discussed with respect to FIGS. 1 and 2.

The EARTL 15 is useful with smaller sub-bass systems, such as in the case when the baffle 20 does not provide adequate area. An extension of the VARTL 12 formed by the first right angle of the cabinet 10 edge and continuing along the cabinet walls tends to cause continued attenuation of the driver output before it is introduced into the ambient air. The EARTL 15 would permit smaller drivers and enclosures to load to lower tuning frequencies. A suitable EARTL 15 comprises an ADTM on the outer, inner or both walls of the VARTL 12.

Figure 6:
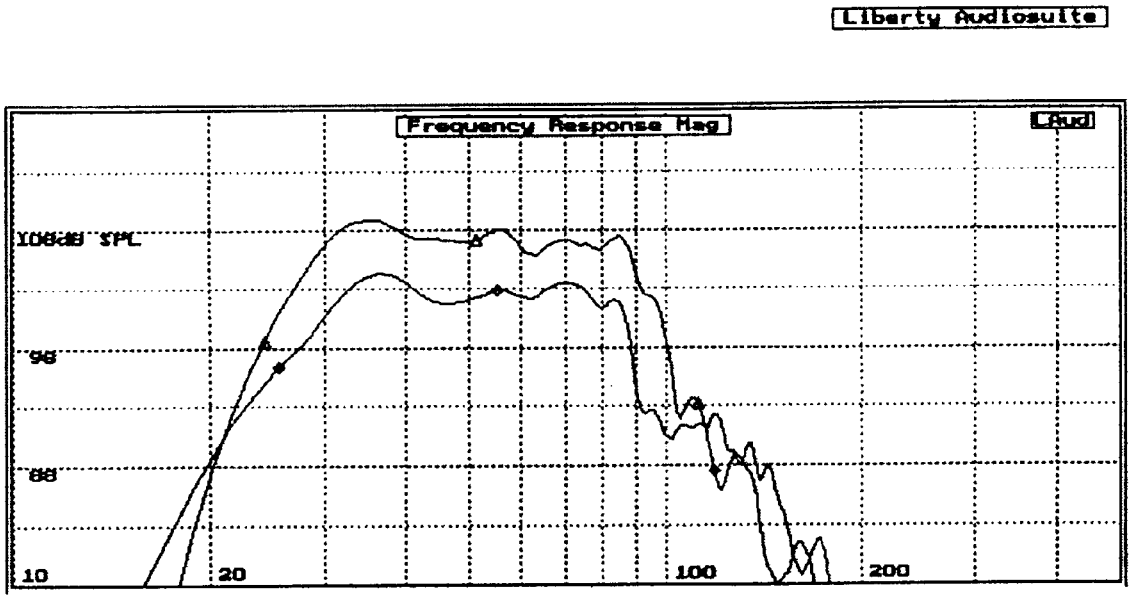
FIG. 6 is a frequency response comparison of two different sized sub-woofers.

FIG. 6 shows a frequency response comparison of two different sized sub-woofers.

The comparison is made with a microphone placed at a 12 inch distance from the port. The top curve is that of a 5 inch driver operating in an enclosure of 0.25 cubic feet that has an extended EARTL 15, which is discussed with reference to FIG. 5. The bottom curve is that of an 8 inch driver operating in a 1 cubic foot enclosure with a baffle area only VARTL 12, as discussed with reference to FIG. 1. The larger driver requires less transmission line length versus diameter than the small driver to establish loading in order to achieve the same frequency response.

However, the sensitivity of the small system is less. The same active filter-amplifier is used for both systems. The use of the VARTL 12 has normalized the low frequency response of two drivers, which are 33% different in size, and of enclosures that are 75% different in size.

Noting that cone excursion is minimal at box resonance, maximum excursion at this frequency results in greater system effectiveness as a sub-woofer. Providing sufficient low pass filtering at the electrical input will reduce excursion as the system approaches driver resonance. Wavelengths get shorter as the driver resonance is approached from the sub-bass region, which assists in reducing the excursion of the cone 24 at unessential upper bass frequencies.

Active amplification systems are effective in signal response shaping. For instance, using the VARTL 12 in conjunction with an 8 inch driver and reflex enclosure, the output signal to the woofer from its amplifier at 30 Hz can produce the same level as the same signal input to a 15 inch woofer requiring extension to 30 Hz. Thus, much greater relative efficiency is achieved by eliminating dynamically varying pressure imbalances at the cone of the bass transducer.

Moreover, by reducing the reactive pressure imbalances, transient response is greatly enhanced and the driver cone motion is more faithful to the input signal. High level non-linearity is reduced as the high unsymmetrical pressures created in closed boxes and the random loading pressures encountered at the diaphragm of the standard reflex are avoided.

While the invention has been particularly shown and described with reference to a preferred embodiment hereof, it will be understood by those skilled in the art that several changes in form and detail may be made without departing from the spirit and scope of the invention.

I claim:

1. A loudspeaker that provides improved sub-bass frequency responses comprising: a cabinet, a dynamic driver connected to a driver cone; a virtual acoustic radial transmission line (VARTL) disposed around and in front of said cone of said driver to isolate said driver from reflected signals, said VARTL defined by a first waveguide, a second waveguide and a third waveguide, wherein said second wave guide is a right angle waveguide; said first waveguide positioned proximate to and in front of said driver cone; said right angle waveguide positioned radially proximate to said third waveguide and generally between said first waveguide and said third waveguide; and an alternative density transmission medium (ADTM) disposed between said first waveguide and said third waveguide, wherein said loudspeaker further contains a tuned port in said cabinet.

2. The loudspeaker cabinet of claim 1, wherein said virtual acoustic radial transmission line comprises: said first waveguide, said second waveguide, said third waveguide, and said ADTM, wherein said third waveguide is defined by a baffle board carrying a layer of said ADTM, wherein said baffle board cooperates with said first and second waveguides to define VARTL transmission line dimensions and a mouth area thereof.

* * * * *